US010342085B2

(12) United States Patent
Joo et al.

(10) Patent No.: US 10,342,085 B2
(45) Date of Patent: Jul. 2, 2019

(54) BACK LIGHT DEVICE AND CONTROLLING METHOD THEREOF

(71) Applicant: SAMSUNG ELECTRONICS CO., LTD., Suwon-si (KR)

(72) Inventors: Sung Yong Joo, Hwaseong-si (KR); Jin Hyung Lee, Anyang-si (KR); Moon Young Kim, Pohang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/698,848

(22) Filed: Sep. 8, 2017

(65) Prior Publication Data

US 2018/0070415 A1 Mar. 8, 2018

(30) Foreign Application Priority Data

Sep. 8, 2016 (KR) ..... 10-2016-0115694

(51) Int. Cl.
*H05B 33/08* (2006.01)
*G09G 3/34* (2006.01)
*G09G 3/36* (2006.01)

(52) U.S. Cl.
CPC ..... *H05B 33/083* (2013.01); *G09G 3/342* (2013.01); *G09G 3/3406* (2013.01); *G09G 3/36* (2013.01); *H05B 33/0815* (2013.01); *H05B 33/0827* (2013.01); *H05B 33/0845* (2013.01); *G09G 2320/0204* (2013.01); *G09G 2320/0247* (2013.01); *G09G 2320/064* (2013.01); *G09G 2320/0626* (2013.01); *G09G 2320/0693* (2013.01); *G09G 2330/025* (2013.01)

(58) Field of Classification Search
None
See application file for complete search history.

(56) References Cited

U.S. PATENT DOCUMENTS

| | | | | |
|---|---|---|---|---|
| 9,320,097 | B2 | 4/2016 | Zhang et al. | |
| 9,326,343 | B2 | 4/2016 | Yan et al. | |
| 9,326,344 | B2 | 4/2016 | Malyna et al. | |
| 9,338,841 | B2 | 5/2016 | Leshniak | |
| 9,370,063 | B2 | 6/2016 | Bong et al. | |
| 2008/0042599 | A1 * | 2/2008 | Ashdown ..... | H05B 33/0818 315/294 |

(Continued)

FOREIGN PATENT DOCUMENTS

JP 2013127881 A * 6/2013

*Primary Examiner* — Dedei K Hammond
(74) *Attorney, Agent, or Firm* — Sughrue Mion, PLLC

(57) ABSTRACT

A back light device includes a first light emitting block including a plurality of light emitting modules connected in series to each other; a power supply module that applies a driving voltage to the first light emitting block; a first power switch connected to the first light emitting block and controls the driving voltage on or off; and a control module that turns on or off the first power switch such that a constant current is supplied to the first light emitting block and controls an on/off of the plurality of light emitting modules based on a dimming signal. The control module, in response to a ripple value of the constant current being different from a certain ripple value, changes at least one of a turn-on period and a turn-off period of the first power switch to calibrate the ripple value of the constant current to the certain ripple value.

20 Claims, 11 Drawing Sheets

(56) References Cited

U.S. PATENT DOCUMENTS

| | | | | |
|---|---|---|---|---|
| 2012/0062147 | A1* | 3/2012 | Fan | H05B 33/0815 315/297 |
| 2014/0021885 | A1 | 1/2014 | Yan et al. | |
| 2014/0028191 | A1 | 1/2014 | Leshniak | |
| 2014/0333216 | A1 | 11/2014 | Zhang et al. | |
| 2014/0354165 | A1 | 12/2014 | Malyna et al. | |
| 2015/0373799 | A1 | 12/2015 | Bong et al. | |

* cited by examiner

BACK LIGHT DEVICE AND CONTROLLING METHOD THEREOF

CROSS-REFERENCE TO RELATED APPLICATION(S)

This application claims priority from Korean Patent Application No. 10-2016-0115694, filed on Sep. 8, 2016, in the Korean Intellectual Property Office, the entire disclosure of which is hereby incorporated by reference.

BACKGROUND

1. Field

One or more exemplary embodiments relate to a back light device for emitting back light to a display panel and a method for controlling the back light device.

2. Discussion of Related Art

A technology for displaying image information is being developed from a conventional cathode-ray tube (CRT) to a flat panel display such as a plasma display panel (PDP), a liquid crystal display (LCD) panel, and a light emitting diode (LED) panel.

In the LCD panel, the transmittance of liquid crystal may change according to a voltage applied thereto. The LCD panel may provide a user with an image by emitting light from a light source disposed at a rear side thereof to a panel disposed at a front side thereof. That is, since the LCD panel is not self-illuminated, the LCD panel generally needs a separate back light.

An LED, a fluorescent lamp, or the like may be used as the back light. In particular, since the LED has a high response speed and a long lifespan, the LED has been used as the back light of the LCD panel.

SUMMARY

A display including the LCD panel may form channels by dividing the display into a plurality of areas and may improve the performance of the display by controlling the respective channels. However, a convertor may be required for each channel to control a back light of a channel, thereby making it difficult to manufacture the display slimly and increasing manufacturing costs.

If each channel is controlled while a plurality of channels are connected to one converter, a voltage of a back light may fluctuate according to on/off of each channel, thereby causing fluctuations in a ripple value of a constant current supplied to the back light.

One or more exemplary embodiments address at least the above-mentioned problems and/or disadvantages and to provide at least the advantages described below. Accordingly, one or more exemplary embodiments provide a back light device for controlling a plurality of channels with one converter without fluctuations in a ripple value of a constant current supplied to a back light and a method for controlling the back light device.

In accordance with an aspect of an exemplary embodiment, a back light device may include a first light emitting block including a first plurality of light emitting modules connected in series to each other; a power supply module configured to apply a driving voltage to the first light emitting block; a first power switch connected to the first light emitting block and configured to control the driving voltage on or off; and a control module configured to turn on or off the first power switch such that a constant current is supplied to the first light emitting block and to control an on/off of the first plurality of light emitting modules based on a dimming signal, wherein the control module is configured to, in response to a ripple value of the constant current being different from a certain ripple value, change at least one of a turn-on period and a turn-off period of the first power switch to calibrate the ripple value of the constant current to the certain ripple value.

In accordance with another aspect of an exemplary embodiment, a method for controlling a back light device may include turning on or off a first power switch to supply a constant current to a first light emitting block; turning on or off a plurality of light emitting modules included in the first light emitting block based on a dimming signal; verifying the constant current supplied to the first light emitting block; and in response to a ripple value of the constant current being different from a certain ripple value, changing at least one of a turn-on period and a turn-off period of the first power switch to calibrate the ripple value of the constant current.

In accordance with still another aspect of an exemplary embodiment, a non-transitory computer-readable recording medium may store a program which, when executed by a computer, causes the computer to perform: turning on or off a first power switch to supply a constant current to a first light emitting block; turning on or off a plurality of light emitting modules included in the first light emitting block based on a dimming signal; verifying the constant current supplied to the first light emitting block; and in response to a ripple value of the constant current being different from a certain ripple value, changing at least one of a turn-on period and a turn-off period of the first power switch to calibrate the ripple value of the constant current.

BRIEF DESCRIPTION OF THE DRAWINGS

The above and/or other aspects, features, and advantages of certain embodiments will be more apparent from the following description taken in conjunction with the accompanying drawings, in which.

DETAILED DESCRIPTION

Figure 1:
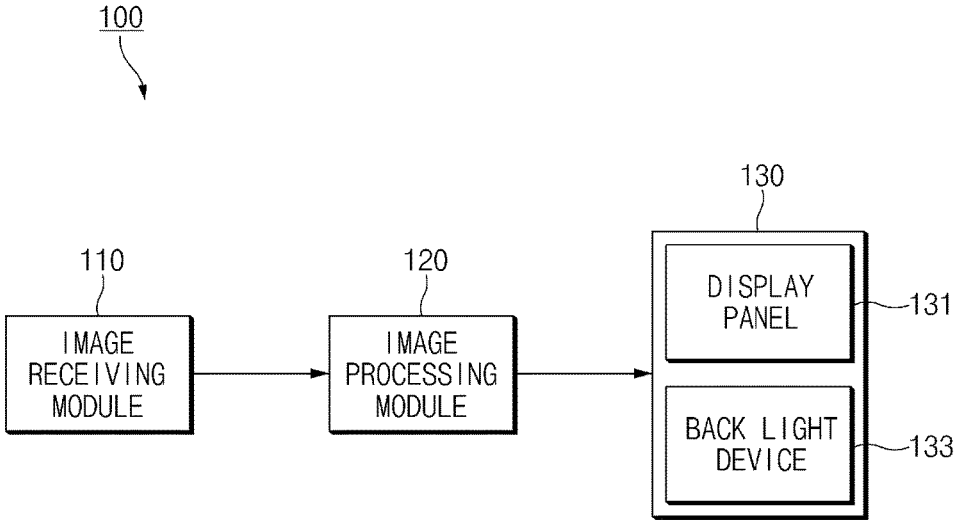
FIG. 1 is a block diagram illustrating a configuration of a display device according to an exemplary embodiment.

Various exemplary embodiments may be described with reference to accompanying drawings. Accordingly, those of ordinary skill in the art will recognize that modification, equivalent, and/or alternative on the various exemplary embodiments described herein can be variously made without departing from the scope and spirit of the disclosure. Throughout the drawings, it should be noted that like reference numbers are used to depict the same or similar elements, features, and structures.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing the scope of the disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other components. A central processing unit (CPU), for example, a "processor configured to perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this disclosure are used to describe specified exemplary embodiments and are not intended to limit the scope of the disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined herein in various exemplary embodiments. In some cases, even if terms are defined in the disclosure, they may not be interpreted to exclude exemplary embodiments.

FIG. 1 is a block diagram illustrating a configuration of a display device according to an exemplary embodiment.

Referring to FIG. 1, a display device 100 may include an image receiving module 110, an image processing module 120, and a display module 130.

The image receiving module 110 may receive an image (e.g., a video image) from an external electronic device. The image receiving module 110 may be wirelessly or wiredly connected with the external electronic device to receive an image signal. The external electronic device may receive content, for example, over a broadcast network or an Internet network and may transmit the received content to the display device 100. For another example, the external electronic device may reproduce content stored in a record medium (e.g., a compact disk (CD), a digital versatile disc (DVD), a hard disk, or the like) and may transmit the reproduced content to the display device 100.

The image processing module 120 may receive an image signal from the image receiving module 110 and may perform image processing, such as image decoding, image scaling, frame rate conversion (FRC), or the like, on the received image signal.

The display module 130 may include a display panel 131 and a back light device 133. The display module 130 may display an image output from the image processing module 120 on the display panel 131. For example, the display panel 131 may be a liquid crystal display (LCD) panel. The back light device 133 may emit back light to the display panel 131 to allow a user to view an image displayed on the display panel 131.

Figure 2:
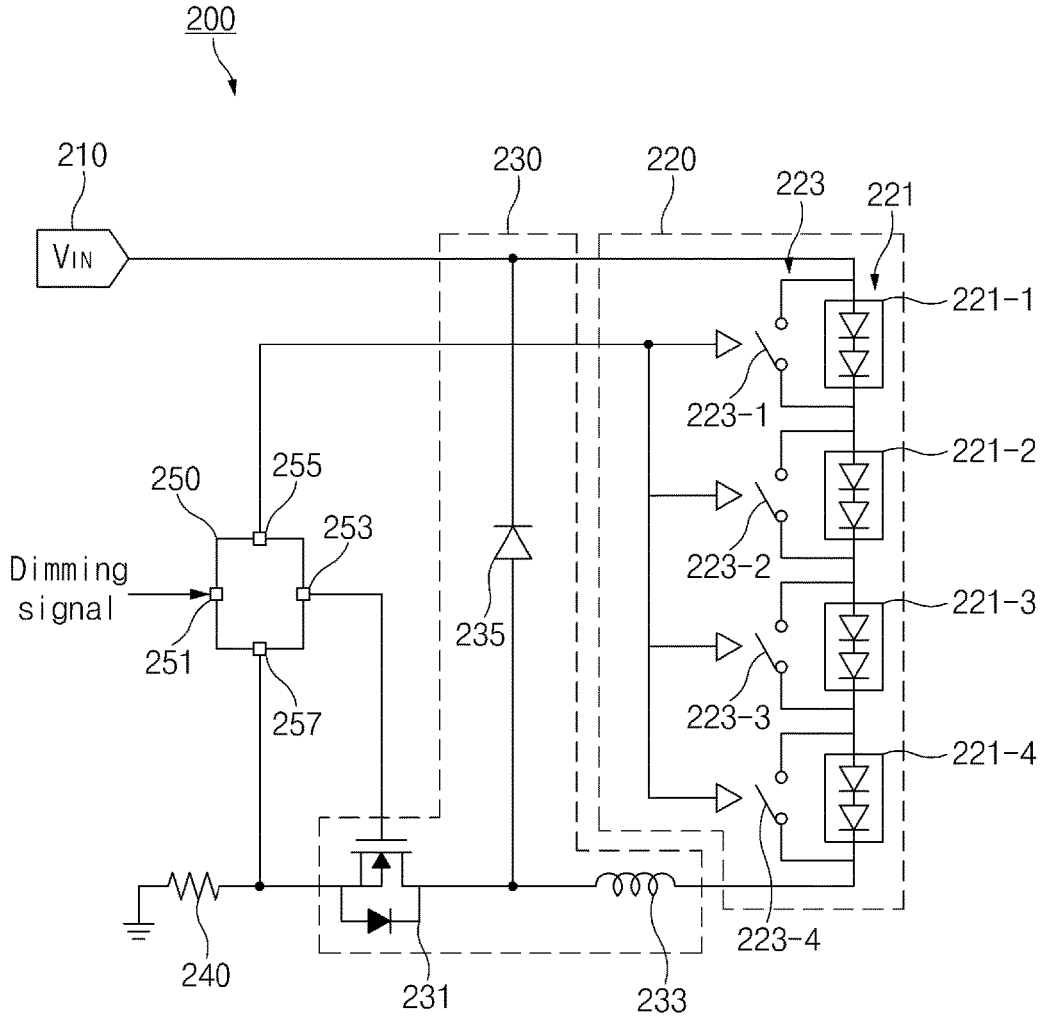
FIG. 2 is a circuit diagram illustrating a back light device according to an exemplary embodiment.

FIG. 2 is a circuit diagram illustrating a back light device according to an exemplary embodiment.

Referring to FIG. 2, a back light device 200 may include a power supply module 210, a light emitting block 220, a convertor 230, a resistor 240, and a control module 250.

The power supply module 210 may be connected to the light emitting block 220 to apply a driving voltage. For example, the power supply module 210 may rectify an input AC voltage to a DC voltage and may supply the DC voltage to the light emitting block 220. Accordingly, the power supply module 210 may apply a DC driving voltage to the light emitting block 220.

The light emitting block 220 may include a plurality of light emitting modules 221 and a plurality of channel switches 223.

According to an exemplary embodiment, the plurality of light emitting modules 221 may be connected in series to each other. The plurality of light emitting modules 221 may emit the back light to a display panel. For example, the plurality of light emitting modules 221 may include a first light emitting module 221-1, a second light emitting module 221-2, a third light emitting module 221-3, and a fourth light emitting module 221-4 that are connected in series to each other. Each of the light emitting modules 221-1, 221-2, 221-3, and 221-4 may include a plurality of light emitting elements. Each of the light emitting elements may be, for example, a fluorescent lamp, a light emitting diode (LED), or the like.

According to an exemplary embodiment, the plurality of channel switches 223 may be respectively connected with the plurality of light emitting modules 221 to control an on/off of the plurality of light emitting modules 221. For example, the plurality of channel switches 223 may include a first channel switch 223-1, a second channel switch 223-2, a third channel switch 223-3, and a fourth channel switch 223-4. The channel switches 223-1, 223-2, 223-3, and 223-4 may be on (or closed) or off (or opened) to make the plurality of light emitting modules 221 off or on, respectively. Each of the channel switches 223-1, 223-2, 223-3, and 223-4 may include a switch including a field effect transistor (FET), for example.

In this case, a display device may be driven in a local dimming manner. The local dimming manner may refer to a method of controlling brightness while a display is divided into a plurality of areas. The display device may form the back light device (or a panel) with a plurality of channels to control the plurality of areas of the display, respectively. For example, one of the plurality of channels may be formed of one light emitting module 221-1, 221-2, 221-3, or 221-4 among the plurality of light emitting modules 221. The light emitting modules 221-1, 221-2, 221-3, and 221-4 may be respectively controlled by the plurality of channel switches 223. The display device may control the divided areas of the display by respectively turning on or off the channel switches 223-1, 223-2, 223-3, and 223-4 such that the channels including the plurality of light emitting modules 221 are on or off.

The convertor 230 may include a power switch 231, an inductor 233, and a diode 235. The power switch 231 may be, for example, a switch including a field effect transistor (FET) and may be connected between the light emitting block 220 and a ground. The inductor 233 may be connected between the light emitting block 220 and the power switch 231. The diode 235 may be connected in parallel with the light emitting block 220 and the inductor 233 that are connected in series to each other.

According to an exemplary embodiment, the power switch 231 may make power supplied by the power supply module 210 on or off. A drain, a source, and a gate of the power switch 231 may be respectively connected to the light emitting block 220, the ground, and the control module 250 to connect or disconnect the light emitting block 220 and the ground.

According to an exemplary embodiment, the inductor 233 may be charged or discharged by an on/off of the power switch 231 to allow a current to continuously flow to the light emitting block 220. The inductor 233 may be charged by the power supply module 210 when the power switch 231 is on and may be discharged when the power switch 231 is off. Accordingly, a current may flow to the light emitting block 220 through the charging and discharging operations of the inductor 233.

According to an exemplary embodiment, the diode 235 may allow a current to flow to the light emitting block 220. A cathode of the diode 235 may be connected to a node between the power supply module 210 and the light emitting block 220, and an anode thereof may be connected to a node between the power switch 231 and the inductor 233. When the power switch 231 is on or off, the diode 235 may allow a current by the power supply module 210 and the inductor 233 being discharged to flow to the light emitting block 220.

The resistor 240 may be connected between the power switch 231 and the ground. A current that flows to the light emitting block 220 when the power switch 231 is on may flow to the resistor 240, and the control module 250 may measure a current based on a voltage applied to the resistor 240.

The control module 250 may control overall operations of the back light device 200. The control module 250 may include an integrated circuit (IC). For example, the IC may include a dimming signal terminal 251, a power switch terminal 253, a channel switch terminal 255, and a voltage measurement terminal 257.

According to an exemplary embodiment, the control module 250 may be provided with a dimming signal from the outside (e.g., a main processor of a display device) through the dimming signal terminal 251. The control module 250 may generate a signal for turning on or off the power switch 231 and the plurality of channel switches 223 by using the dimming signal.

According to an exemplary embodiment, the control module 250 may generate a signal for turning on or off the power switch 231 through the power switch terminal 253. The power switch terminal 253 may be connected to the gate of the power switch 231 to control an on/off of the power switch 231. For example, the control module 250 may turn on or off the power switch 231 at a specified period depending on the dimming signal such that a constant current is supplied to the light emitting block 220. For another example, in the case where a ripple value of the constant current is different from a specified ripple value, the control module 250 may change an on/off period (or a turn-on period and a turn-off period) of the power switch 231 to calibrate the ripple value of the constant current to the specified ripple value.

According to an exemplary embodiment, the control module 250 may generate a signal for turning on or off the plurality of channel switches 223 through the channel switch terminal 255. The control module 250 may turn on or off the channel switches 223-1, 223-2, 223-3, and 223-4 in response to the dimming signal, respectively.

According to an exemplary embodiment, the control module 250 may measure a voltage of the resistor 240 through the voltage measurement terminal 257. The control module 250 may measure a current flowing to the resistor 240 through a voltage across the resistor 240, and the current may be the same as a current flowing to the light emitting block 220 when the power switch 231 is on. Accordingly, the control module 250 may verify a ripple value of a constant current flowing to the light emitting block 220. If the verified ripple value is different from the specified ripple value, the control module 250 may control an on/off of the power switch 231 through the power switch terminal 253.

In this case, since a constant current is supplied to the light emitting block 220, a voltage to be applied to the light emitting block 220 may vary with the number of light emitting modules, which are on (or closed), from among the plurality of light emitting modules 221-1, 221-2, 221-3, and 221-4. If a voltage applied to the light emitting block 220 varies, a ripple value of the constant current flowing to the light emitting block 220 may also vary. For this reason, the control module 250 may verify the ripple value of the constant current, and if the verified ripple value is different from the specified ripple value, the control module 250 may change an on/off period of the power switch 231 to calibrate the ripple value of the constant current to the specified ripple value.

Figure 3:
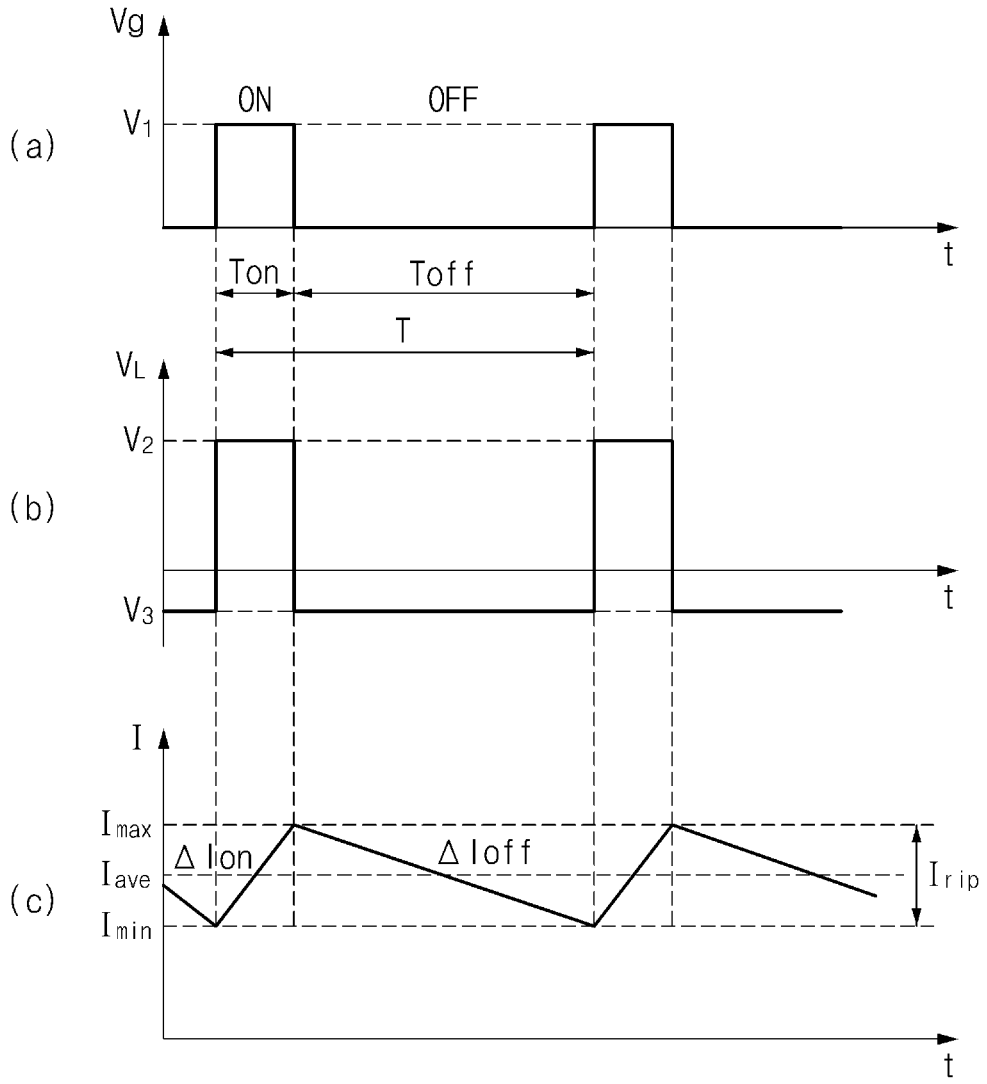
FIG. 3 is a graph indicating a voltage of an inductor and a current flowing to a light emitting block when a power switch is on or off, according to an exemplary embodiment.

FIG. 3 is a graph indicating a voltage of an inductor and a current flowing to a light emitting block when a power switch is on or off, according to an exemplary embodiment.

Referring to FIG. 3, a graph (a) indicates a voltage Vg of a gate of the power switch 231 when the power switch 231 is turned on or off by the control module 250. The power switch 231 may be turned on or off depending on a specified on/off period "T" of the control module 250. The on/off period "T" may include an on time (or a turn-off period) Ton and an off time (or a turn-off period) Toff. For example, the control module 250 may apply a first voltage $V_1$ to the gate of the power switch 231 during the on time Ton to turn on the power switch 231, and the control module 250 may not apply the first voltage $V_1$ to the power switch 231 during the off time Toff to turn off the power switch 231.

A graph (b) indicates a voltage $V_L$ applied to the inductor 233 when the power switch 231 is turned on or off. For example, a second voltage $V_2$ may be applied to the inductor 233 during the on time Ton, and the inductor 233 may be charged by the power supply module 210. A third voltage V3 may be applied to the inductor 233 during the off time Toff, and the inductor 233 may supply a current to the light emitting block 220.

A graph (c) indicates a current "I" flowing to the light emitting block 220 when the power switch 231 is turned on or off. For example, the current "I" flowing to the light emitting block 220 may be the same as a current flowing to the inductor 233. Since the second voltage $V_2$ is applied to the inductor 233 during the on time Ton, the current "I" flowing to the light emitting block 220 may increase from a minimum current $I_{min}$ to a maximum current $I_{max}$ with a first slope Alon. Since no voltage is applied to the inductor 233 during the off time Toff, the current "I" flowing to the light emitting block 220 may decrease from the maximum current $I_{max}$ to the minimum current $I_{min}$ with a second slope ΔIoff.

Accordingly, a constant current that corresponds to a specified average current $I_{ave}$ may flow to the light emitting block 220, and a ripple value $I_{rip}$ of the constant current, which corresponds to a difference between the maximum current $I_{max}$ to the minimum current $I_{min}$, may be constant.

Figure 4A:
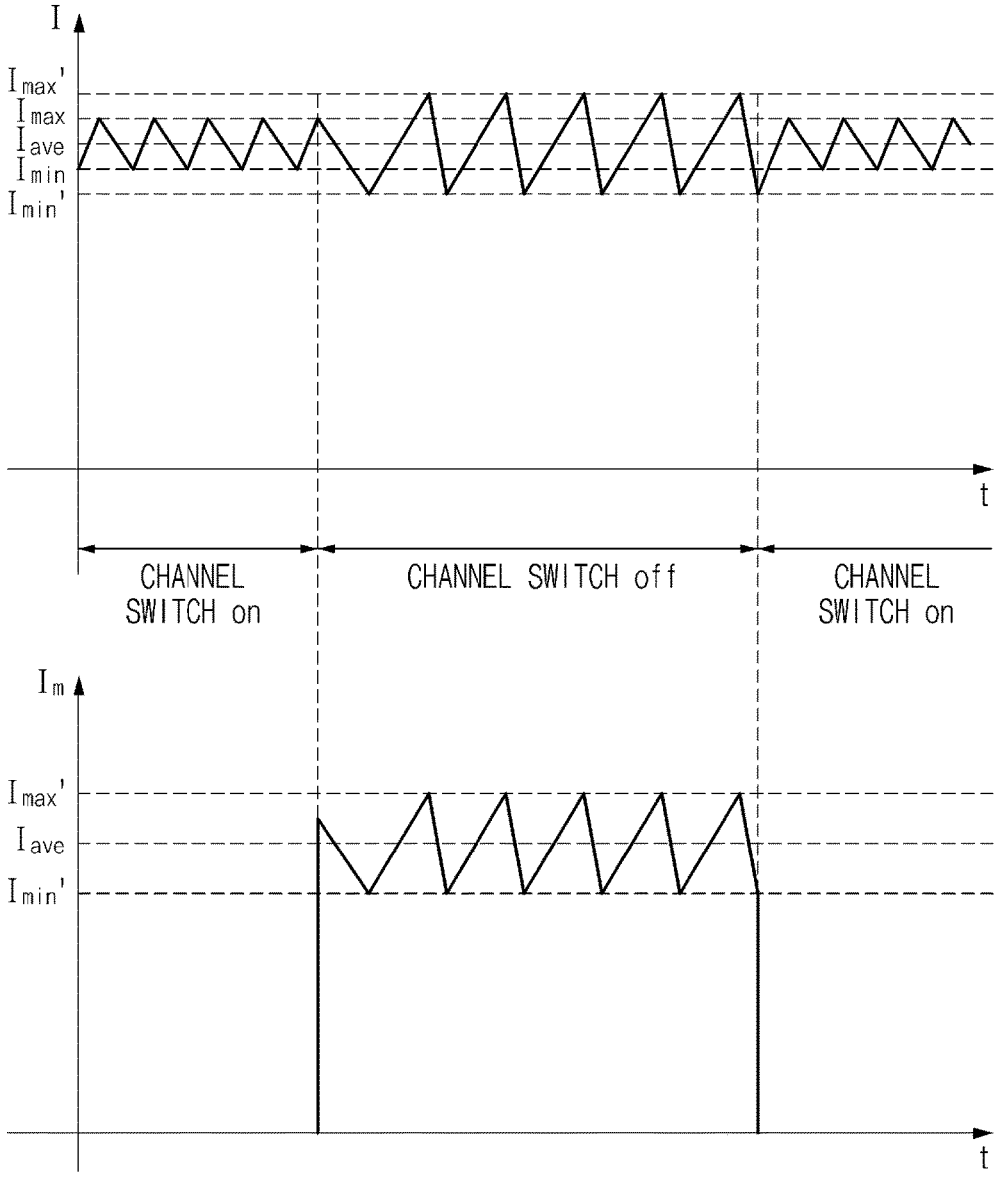
FIGS. 4A and 4B are graphs a current flowing to the light emitting block when one light emitting module is on, according to an exemplary embodiment.
Figure 4B:
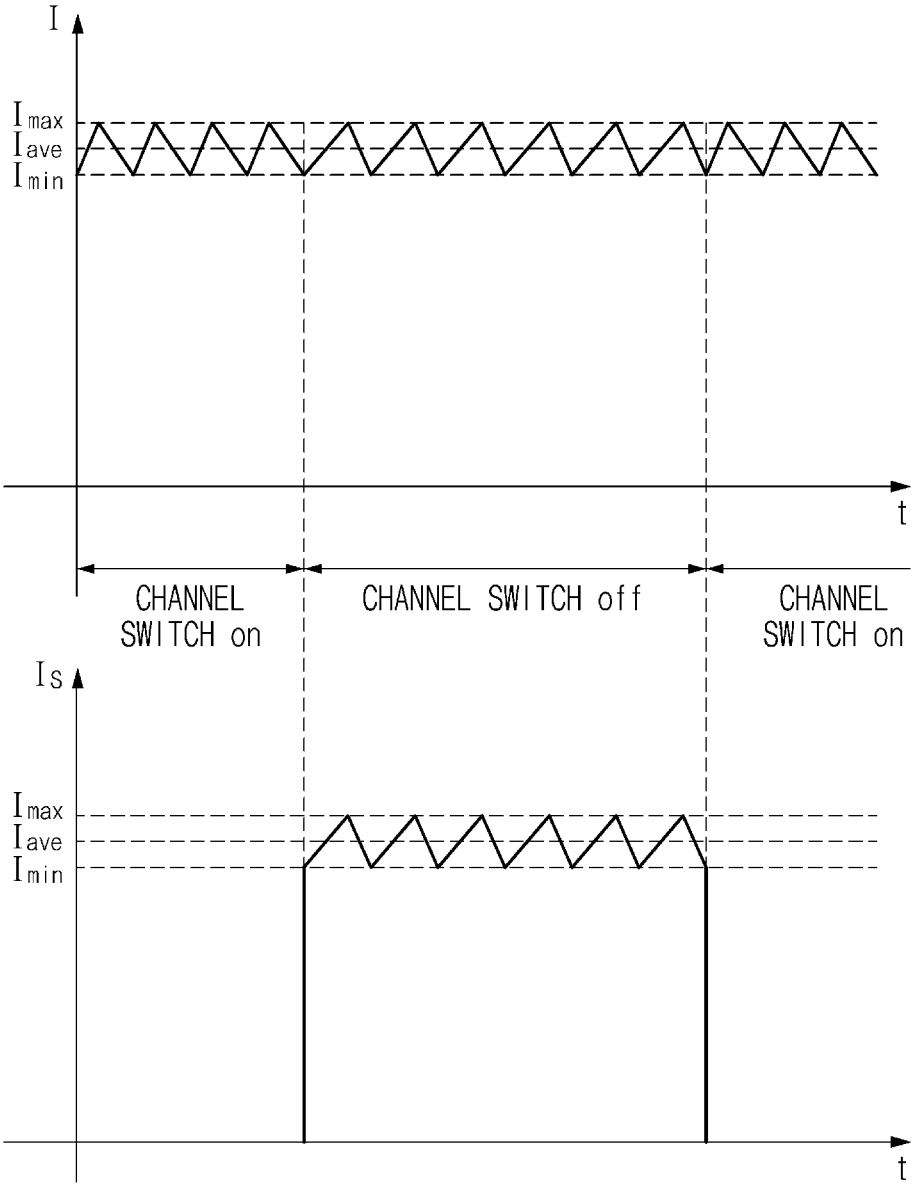

FIGS. 4A and 4B are graphs indicating a current flowing to a light emitting block when one light emitting module is on, according to an exemplary embodiment.

Referring to FIGS. 4A and 4B, a voltage applied to the light emitting block 220 may increase when the fourth channel switch 223-4 is off while the first channel switch 223-1, the second channel switch 223-2, and the third channel switch 223-3 are off, that is, the first light emitting module 221-1, the second light emitting module 221-2, and the third light emitting module 221-3 are on ("CHANNEL SWITCH off" period).

Referring to FIG. 4A, graphs (a) and (b) respectively indicate the current "I" flowing to the light emitting block 220 and a current $I_m$ flowing to the fourth light emitting module 221-4. The minimum current $I_{min}$ and the maximum current $I_{max}$ flowing to the light emitting block 220 may change to a different minimum current $I_{min'}$ and a different maximum current $I_{max}'$ when a voltage applied to the light emitting block 220 increases during the "CHANNEL SWITCH off" period in which the first channel switch 223-1, the second channel switch 223-2, and the third channel switch 223-3 are off. In this case, the ripple value $I_{rip}$ of the constant current supplied to the light emitting block 220 may become greater than the specified ripple value. Jitter may be generated in a display due to a change in the ripple value $I_{rip}$ of the constant current.

Referring to FIG. 4B, graphs (a) and (b) respectively indicate the current "I" flowing to the light emitting block 220 and the current L flowing to the fourth light emitting module 221-4 when an on/off period "T" of the power switch 231 is changed. For example, if the ripple value $I_{rip}$ of the constant current is changed, the control module 250 may change the off time Toff of the on/off period of the power switch 231. If the ripple value $I_{rip}$ of the constant current supplied to the light emitting block 220 is greater than the specified ripple value, the control module 250 may decrease the off time Toff. For another example, if the ripple value $I_{rip}$ of the constant current is changed, the control module 250 may change the on time Ton and the off time Toff of the power switch 231. A ratio of the on time Ton to the off time Toff may be identically maintained. If the ripple value $I_{rip}$ of the constant current supplied to the light emitting block 220 is greater than the specified ripple value, the control module 250 may decrease the on time Ton and the off time Toff. In the case where a voltage applied to the light emitting block 220 is greatly changed such that, for example, two or more of the plurality of light emitting modules 221 are simultaneously on, the control module 250 may simultaneously change both the on time Ton and the off time Toff.

According to an exemplary embodiment, unlike FIGS. 4A and 4B, a voltage applied to the light emitting block 220 may decrease when the fourth channel switch 223-4 is off while the first channel switch 223-1, the second channel switch 223-2, and the third channel switch 223-3 are on, that is, the first light emitting module 221-1, the second light emitting module 221-2, and the third light emitting module 221-3 are off. In this case, the ripple value $I_{rip}$ of the constant current supplied to the light emitting block 220 may become smaller than the specified ripple value. For example, if the ripple value $I_{rip}$ of the constant current supplied to the light emitting block 220 is smaller than the specified ripple value, the control module 250 may increase the off time Toff. For another example, if the ripple value $I_{rip}$ of the constant current supplied to the light emitting block 220 is smaller than the specified ripple value, the control module 250 may increase the on time Ton and the off time Toff with the same ratio. In the case where a voltage applied to the light emitting block 220 is greatly changed such that, for example, two or more of the plurality of light emitting modules 221 are simultaneously off, the control module 250 may simultaneously change both the on time Ton and the off time Toff.

Figure 5:
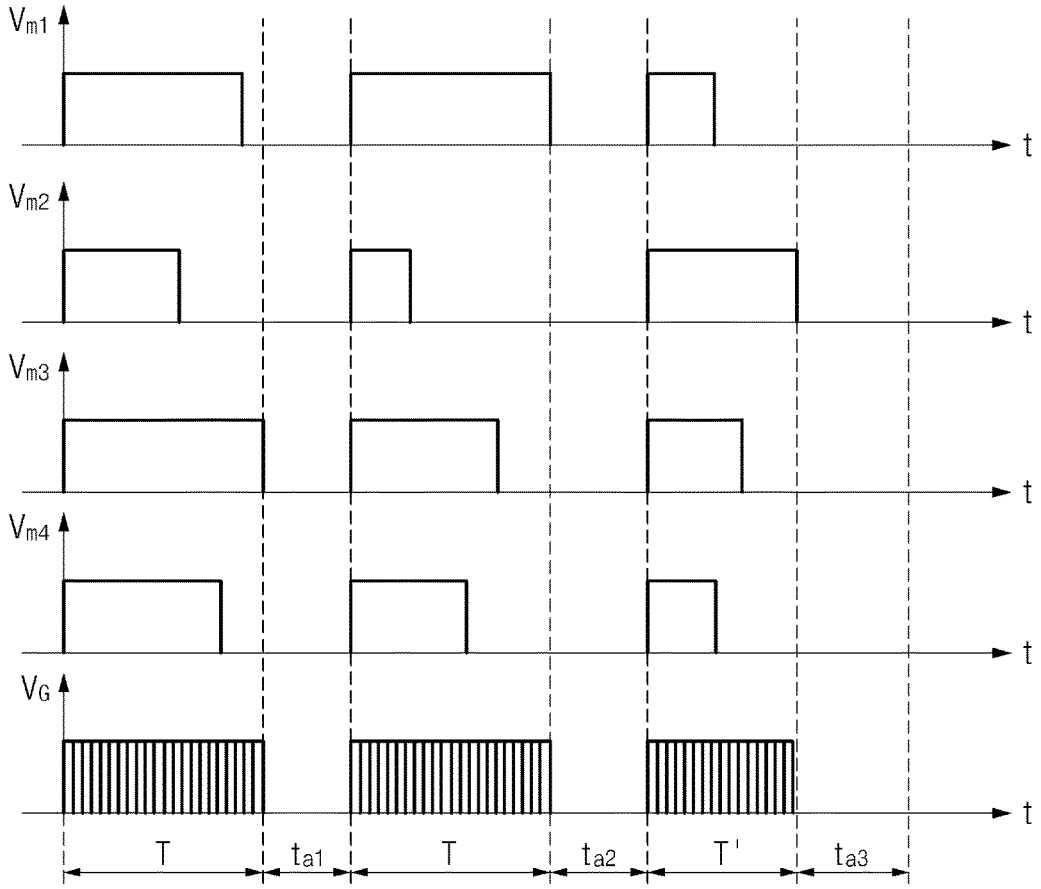
FIG. 5 is a graph for describing how a light emitting module is controlled, according to an exemplary embodiment.

FIG. 5 is a graph for describing how a light emitting module is controlled, according to an exemplary embodiment.

Referring to FIG. 5, when the light emitting modules 221-1, 221-2, 221-3, and 221-4 are respectively turned on, module voltages $V_{m1}$, $V_{m2}$, $V_{m3}$, and $V_{m4}$ may be respectively applied thereto. Times when the module voltages $V_{m1}$, $V_{m2}$, $V_{m3}$, and $V_{m4}$ are respectively applied to the light emitting modules 221-1, 221-2, 221-3, and 221-4 may be on times of the light emitting modules 221-1, 221-2, 221-3, and 221-4. The control module 250 may control the on time of each of the light emitting modules 221-1, 221-2, 221-3, and 221-4 within the on/off period "T" of the power switch 231. If the ripple value $I_{rip}$ of the constant current flowing to the light emitting block 220 is changed, the control module 250 may change the on/off period "T" of the power switch 231 to a different on/off period T'.

According to an exemplary embodiment, the control module 250 may turn on or off the power switch 231 when the plurality of light emitting modules 221 are all turned off depending on a dimming signal (ta1, ta2, and ta3). If the power switch 231 is turned on when the plurality of light emitting modules 221 are all turned off (ta1, ta2, and ta3), opposite ends of the power supply module 210 may be connected with a ground, thereby causing an issue in the power supply module 210. Accordingly, the control module 250 may protect the power supply module 210 by turning off the power switch 231 when the plurality of light emitting modules 221 are all turned off (ta1, ta2, and ta3).

According to various exemplary embodiments described with reference to FIGS. 1 to 5, when there are a serially connected plurality of light emitting modules 221 for emitting the back light to the respective areas of the display, the back light device 200 may adjust the on/off period "T" of the power supply module 231 such that a ripple value of a constant current being supplied to the plurality of light emitting modules 221 is uniformly maintained even if a voltage across the plurality of light emitting modules 221 changes when the plurality of light emitting modules 221 are turned on or off. In this manner, the jitter may be prevented.

Figure 6:
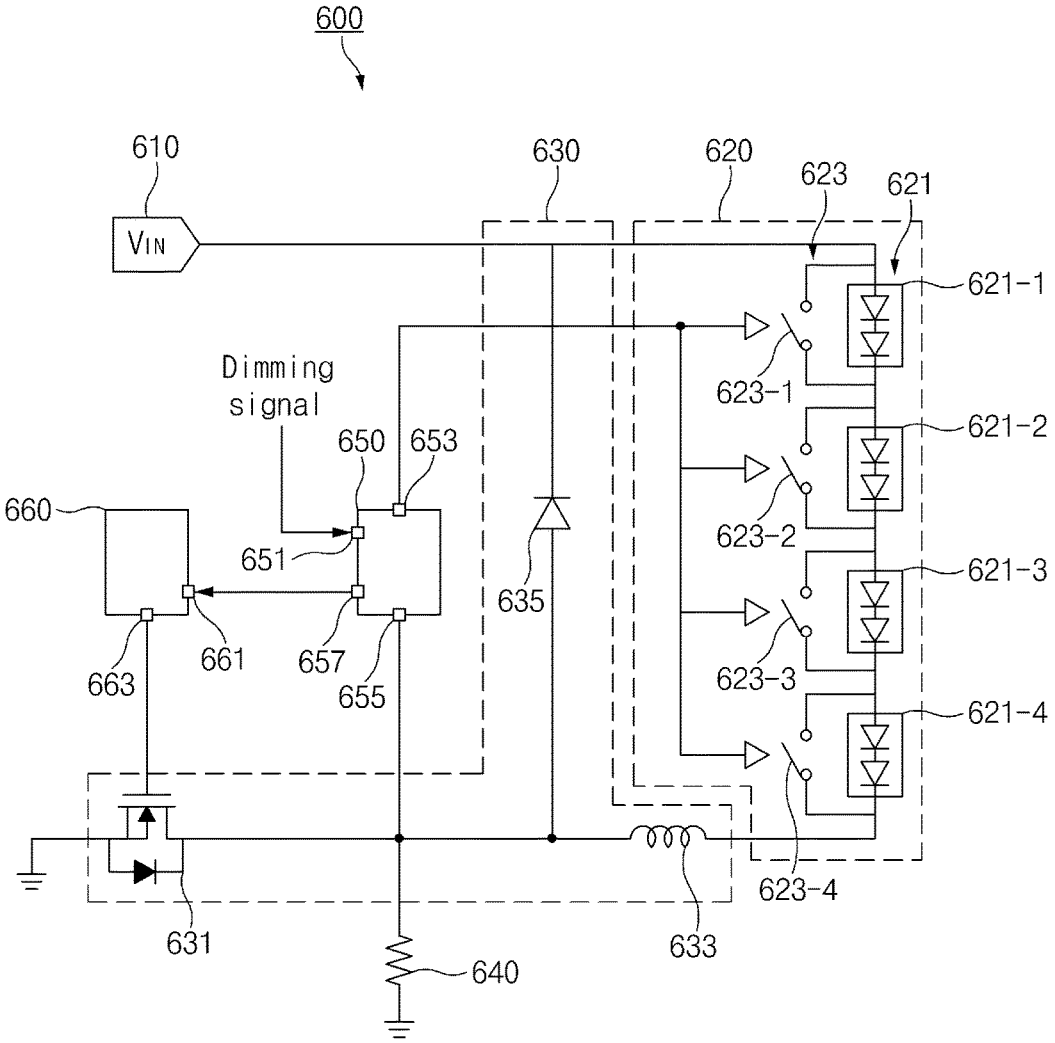
FIG. 6 is a circuit diagram illustrating the back light device including a plurality of control modules, according to an exemplary embodiment.

FIG. 6 is a circuit diagram illustrating a back light device including a plurality of control modules, according to an exemplary embodiment.

Referring to FIG. 6, a back light device 600 may include a power supply module 610, a light emitting block 620, a convertor 630, a resistor 640, a first control module 650, and a second control module 660.

The power supply module 610, the light emitting block 620, the convertor 630, and the resistor 640 may be similar to the power supply module 210, the light emitting block 220, the convertor 230, and the resistor 240 of the back light device 200 of FIG. 2. Repeated descriptions will be omitted.

The first control module 650 and the second control module 660 may control overall operations of the back light device 600. Each of the first control module 650 and the second control module 660 may include an IC. For example, the IC of the first control module 650 may include a dimming signal terminal 651, a channel switch terminal 653, a voltage measurement terminal 655, and a second control module terminal 657. The IC of the second control module 660 may include a first control module terminal 661 and a power switch terminal 663.

The first control module 650 may be provided with a dimming signal from the outside (e.g., a main processor of a display device) through the dimming signal terminal 651. The first control module 650 may generate a signal for turning on or off a plurality of channel switches 623 by using the dimming signal. The first control module 650 may generate and output a signal for controlling a power switch 631 to the second control module 660 by using the dimming signal.

According to an exemplary embodiment, the first control module 650 may transmit a signal for turning on or off the plurality of channel switches 623 through the channel switch terminal 653. The first control module 650 may turn on or off the channel switches 623-1, 623-2, 623-3, and 623-4 in response to the dimming signal, respectively.

According to an exemplary embodiment, the first control module 650 may measure a voltage of the resistor 640 through the voltage measurement terminal 655. The first control module 650 may measure a current flowing to the resistor 640 through a voltage across the resistor 640, and the current may be the same as a current flowing to the light emitting block 620 when the power switch 631 is on. Accordingly, the first control module 650 may verify a ripple value $I_{rip}$ of a current flowing to the light emitting block 620, and when the verified ripple value $I_{rip}$ is different from the specified ripple value, the first control module 650 may generate and output a signal for controlling the power switch 631 to the second control module 660.

According to an exemplary embodiment, the first control module 650 may transmit a signal for controlling the power switch 631 to the second control module 660 through the second control module terminal 657. For example, the first control module 650 may transmit a signal for turning on or off the power switch 631 to the second control module 660 depending on the dimming signal. For another example, if a ripple value flowing to the light emitting block 620 is different from the specified ripple value, the first control module 650 may transmit a signal for controlling the power switch 631 to the second control module 660.

The second control module 660 may receive a signal for controlling the power switch 631 from the first control module 650 through the second control module terminal 661. The second control module 660 may receive a signal for controlling an on/off of the power switch 631 to generate a signal for turning on or off the power switch 631.

According to an exemplary embodiment, the second control module 660 may generate a signal for turning on or off the power switch 631 through the power switch terminal 663. The power switch terminal 663 may be connected to the gate of the power switch 631 to control an on/off of the power switch 631. For example, the second control module 660 may turn on or off the power switch 631 at a specified period depending on the signal from the first control module 650 such that a constant current is supplied to the light emitting block 620. The received signal may be a signal that the first control module 650 uses to control the power switch 631 depending on a dimming signal. For another example, the second control module 660 may change an on/off period of the power switch 631 depending on the signal received from the first control module 650, to calibrate the ripple value of the constant current to the specified ripple value. The received signal may be a signal that the first control module 650 transmits to the second control module 660 when the ripple value of the constant current is different from the specified ripple value.

As described above, the back light device 600 may stably control the plurality of channel switches 623 and the power switch 631 by separately implementing the first control module 650 to control the plurality of channel switches 623 and the second control module to control the power switch 631.

Figure 7:
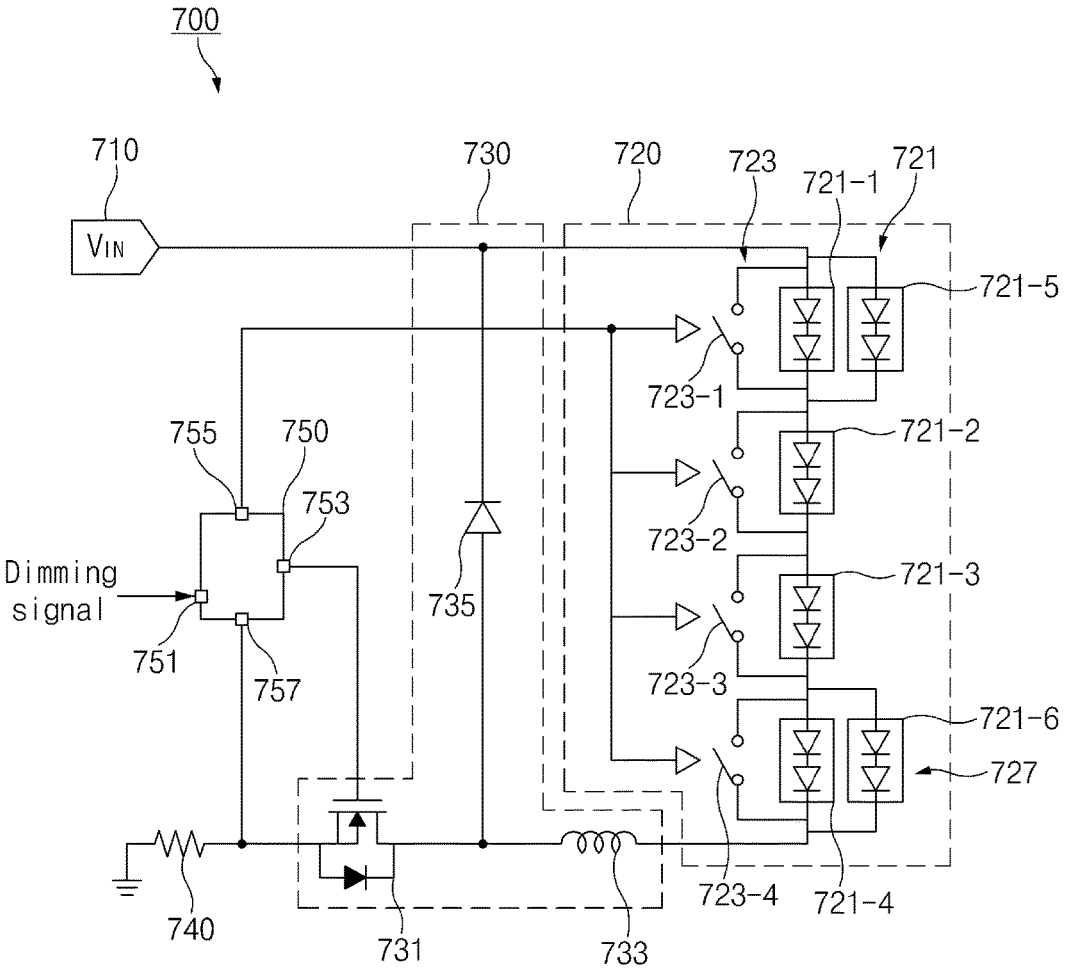
FIG. 7 is a circuit diagram illustrating the back light device in which light emitting modules are connected in parallel, according to an exemplary embodiment.

FIG. 7 is a circuit diagram illustrating a back light device in which light emitting modules are connected in parallel, according to an exemplary embodiment.

Referring to FIG. 7, a back light device 700 may include a power supply module 710, a light emitting block 720, a convertor 730, a resistor 740, and a control module 750.

The power supply module 710, the convertor 730, the resistor 740, and the control module 750 may be similar to the power supply module 210, the convertor 230, the resistor 240, and the control module 250 of the back light device 200 of FIG. 2. Repeated descriptions will be omitted.

The light emitting block 720 may include a plurality of light emitting modules 721 and a plurality of channel switches 723.

According to an exemplary embodiment, the plurality of light emitting modules 721 may be connected in series or in parallel to each other. The plurality of light emitting modules 721 may emit the back light to a display panel. For example, the plurality of light emitting modules 721 may include a first light emitting module 721-1, a second light emitting module 721-2, a third light emitting module 721-3, and a fourth light emitting module 721-4 that are connected in series to each other and may further include a fifth light emitting module 721-5 connected in parallel with the first light emitting module 721-1 and a sixth light emitting module 721-6 connected in parallel with the fourth light emitting module 721-4. Each light emitting element may be, for example, a fluorescent lamp, a light emitting diode (LED), or the like.

According to an exemplary embodiment, the plurality of channel switches 723 may be respectively connected in parallel with the first light emitting module 721-1, the second light emitting module 721-2, the third light emitting module 721-3, and the fourth light emitting module 721-4 to control an on/off thereof. For example, the plurality of channel switches 723 may include a first channel switch 723-1, a second channel switch 723-2, a third channel switch 723-3, and a fourth channel switch 723-4. The first channel switch 723-1 may be connected in parallel with the first light emitting module 721-1 and the fifth light emitting module 721-5, and the fourth channel switch 723-4 may be connected in parallel with the fourth light emitting module 721-4 and the sixth light emitting module 721-6. The channel switches 723-1, 723-2, 723-3, and 723-4 may be on (or closed) or off (or opened) to make the plurality of light emitting modules 721 off or on, respectively. The first channel switch 723-1 may turn on or off the first light emitting module 721-1 and the fifth light emitting module 721-5 at the same time, and the fourth channel switch 723-4 may turn on or off the fourth light emitting module 721-4 and the sixth light emitting module 721-6 at the same time. Each of the channel switches 723-1, 723-2, 723-3, and 723-4 may include a switch including a field effect transistor (FET), for example.

According to an exemplary embodiment, the first light emitting module 721-1 and the fifth light emitting module 721-5 may be connected in parallel with each other to allow a constant current flowing to the light emitting block 720 to flow to the first light emitting module 721-1 and the fifth light emitting module 721-5 separately. The fourth light emitting module 721-4 and the sixth light emitting module 721-6 may be connected in parallel with each other to allow the constant current flowing to the light emitting block 720 to flow to the fourth light emitting module 721-4 and the sixth light emitting module 721-6 separately. Accordingly, the first light emitting module 721-1, the fourth light emitting module 721-4, the fifth light emitting module 721-5, and the sixth light emitting module 721-6 may be darker than the second light emitting module 721-2 and the third light emitting module 721-3, in an on state.

As described above, light emitting modules, which are connected in parallel, from among the plurality of light emitting modules 721 may emit light to a uniformly dark area in a display.

Figure 8:
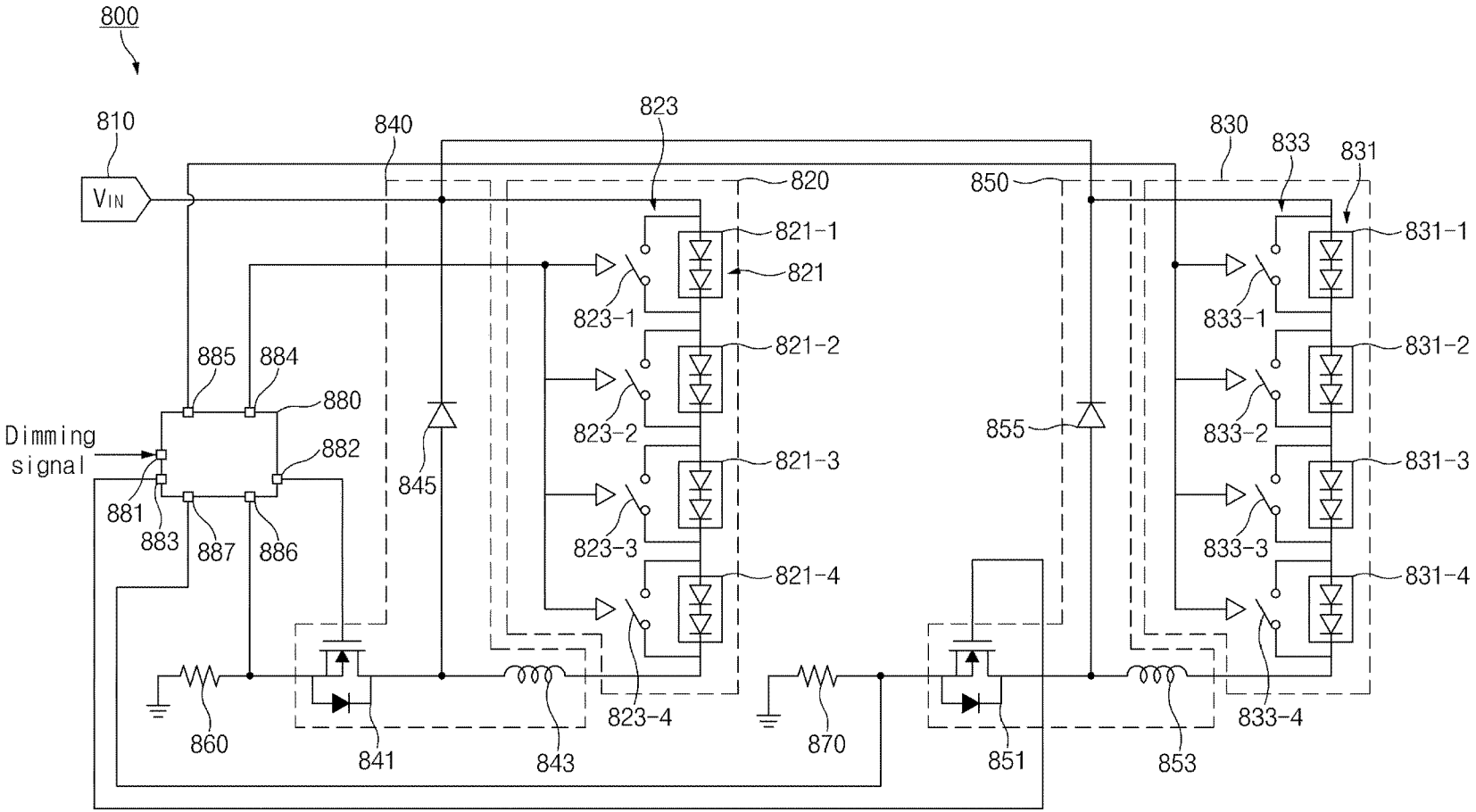
FIG. 8 is a circuit diagram illustrating the back light device in which a plurality of light emitting blocks are connected in parallel, according to an exemplary embodiment.

FIG. 8 is a circuit diagram illustrating a back light device in which a plurality of light emitting blocks are connected in parallel, according to an exemplary embodiment.

Referring to FIG. 8, a back light device 800 may include a power supply module 810, a first light emitting block 820, a second light emitting block 830, a first convertor 840, a second convertor 850, a first resistor 860, a second resistor 870, and a control module 880.

The power supply module 810 may be similar to the power supply module 210 of the back light device 200 of FIG. 2 and may apply a driving voltage to the first light emitting block 820 and the second light emitting block 830. Repeated descriptions will be omitted.

The first light emitting block 820, the first convertor 840, and the first resistor 860 may be similar to the light emitting block 220, the convertor 230, and the resistor 240 of the back light device 200 of FIG. 2. The second light emitting block 830, the second convertor 850, and the second resistor 870 may be similar to the light emitting block 220, the convertor 230, and the resistor 240 of the back light device 200 of FIG. 2. A circuit in which the first light emitting block 820 and the first convertor 840 are connected to each other may be connected in parallel with a circuit in which the second light emitting block 830 and the second convertor 850 are connected to each other.

The control module 880 may control overall operations of the back light device 800. The control module 880 may include an IC. For example, the IC may include a dimming signal terminal 881, a first power switch terminal 882, a second power switch terminal 883, a first channel switch terminal 884, a second channel switch terminal 885, a first voltage measurement terminal 886, and a second voltage measurement terminal 887.

The dimming signal terminal 881 may be similar to the dimming signal terminal 251 of the back light device 200 of FIG. 2.

The first power switch terminal 882, the first channel switch terminal 884, and the first voltage measurement terminal 886 may be similar to the power switch terminal 253, the channel switch terminal 255, and the voltage measurement terminal 257 of the back light device 200 of FIG. 2. The second power switch terminal 883, the second channel switch terminal 885, and the second voltage measurement terminal 887 may be similar to the power switch terminal 253, the channel switch terminal 255, and the voltage measurement terminal 257 of the back light device 200 of FIG. 2. The control module 880 may control the first light emitting block 820, the second light emitting block 830, the first convertor 840, and the second convertor 850, respectively. Also, the control module 800 may supply a constant current to a first power switch 841 and a second power switch 851 respectively by turning on or off the first power switch 841 and the second power switch 851 through the first power switch terminal 882 and the second power switch terminal 883 at a first period and a second period.

According to an exemplary embodiment, the first light emitting block 820 and the second light emitting block 830 may be connected in parallel with each other to allow a constant current supplied by the power supply module 810 to flow the first light emitting block 820 and the second light emitting block 830 separately. For example, in the case where an impedance value of the first light emitting block 820 is smaller than an impedance value of the second light emitting block 830, the amount of a current flowing to the first light emitting block 820 may be greater than the amount of a current flowing to the second light emitting block 830. Accordingly, the first light emitting block 820 may be brighter than the second light emitting block 830.

In the case where the first light emitting block 820 and the second light emitting block 830 are connected in parallel, a bright light emitting block may emit light to a uniform bright area of a display, and a dark light emitting block may emit light to a uniform dark area of the display.

Figure 9:
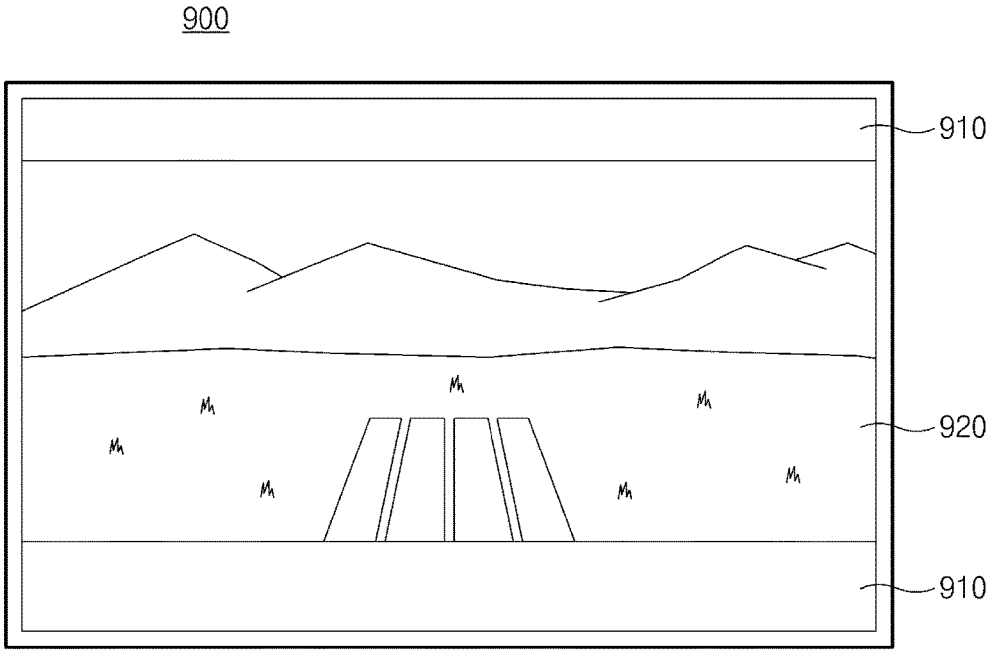
FIG. 9 is a view illustrating a screen displayed in a display of the display device according to an exemplary embodiment.

FIG. 9 is a view illustrating a screen displayed in a display of a display device according to an exemplary embodiment.

Referring to FIG. 9, an image displayed in a display 900 of a display device may include an information transfer area 910 and an image area 920. The information transfer area 910 may refer to an area in which information such as subtitles is provided and may be uniformly dark. The image area 920 may refer to an area in which an image is displayed and may be uniformly bright.

In the case of the back light device 700 of FIG. 7, the first light emitting module 721-1, the fourth light emitting module 721-4, the fifth light emitting module 721-5, and the sixth light emitting module 721-6 may be disposed in the information transfer area 910 that is uniformly dark, and the second light emitting module 721-2 and the third light emitting module 721-3 may be disposed in the image area 720.

In the case of the back light device 800 of FIG. 8, the first light emitting block 820 may be disposed in the image area 920 that is uniformly bright, and the second light emitting block 830 may be disposed in the information transfer area 910 being a uniformly dark area.

Accordingly, the display device may implement a local dimming manner efficiently in the case of a cinema mode and in the case where a bright area and a dark area are distinguishable from each other.

Figure 10:
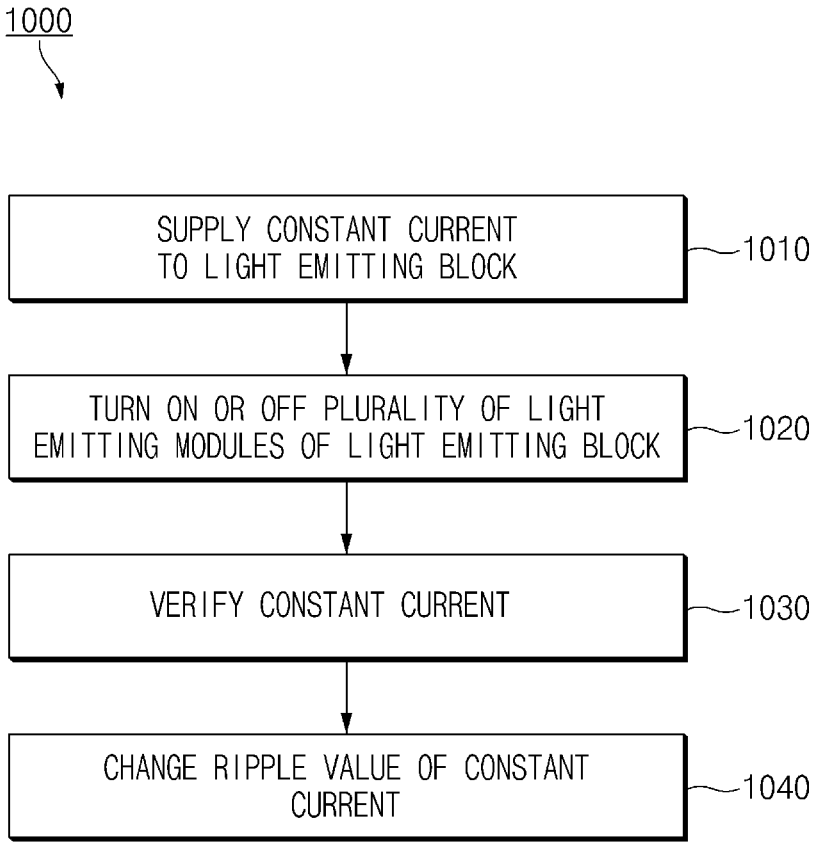
FIG. 10 is a flowchart illustrating a method for controlling the back light device according to an exemplary embodiment.

FIG. 10 is a flowchart illustrating a method for controlling a back light device according to an exemplary embodiment.

The flowchart illustrated in FIG. 10 may include operations performed by any one of the back light devices 200, 600, 700, and 800. Even if omitted below, information about the back light device described with reference to FIGS. 1 to 9 may be applied to the flowchart illustrated in FIG. 10.

According to an exemplary embodiment, in operation 1010, the back light device 200 may supply a constant current to the light emitting block 220. For example, the control module 250 may control an on/off of the power switch 231 to supply power to the light emitting block 220.

According to an exemplary embodiment, in operation 1020, the back light device 200 may turn on or off the plurality of light emitting modules 221 of the light emitting block 220. For example, the control module 250 may control an on/off of the plurality of channel switches 223 depending on the dimming signal to turn on or off the plurality of light emitting modules 221.

According to an exemplary embodiment, in operation 1030, the back light device 200 may verify the constant current. For example, the control module 250 may measure a voltage of the resistor 240 to verify a ripple value of the constant current flowing to the light emitting block 220.

According to an exemplary embodiment, in operation 1040, the back light device 200 may change the ripple value of the constant current in the case where the verified ripple value of the constant current is different from the specified ripple value. For example, the control module 250 may change an on/off period "T" of the power switch 231 to calibrate the ripple value of the constant current to the specified ripple value.

The term "module" used herein may represent, for example, a unit including one or more combinations of hardware, software and/or firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

For example, at least one of these components, elements or units may use a direct circuit structure, such as a memory, a processor, a logic circuit, a look-up table, etc. that may execute the respective functions through controls of one or more microprocessors or other control apparatuses. Also, at least one of these components, elements or units may be specifically embodied by a module, a program, or a part of code, which contains one or more executable instructions for performing specified logic functions, and executed by one or more microprocessors or other control apparatuses. Also, at least one of these components, elements or units may further include or implemented by a processor such as a central processing unit (CPU) that performs the respective functions, a microprocessor, or the like. Two or more of these components, elements or units may be combined into one single component, element or unit which performs all operations or functions of the combined two or more components, elements of units. Also, at least part of functions of at least one of these components, elements or units may be performed by another of these components, element or units. Further, although a bus is not illustrated in the above block diagrams, communication between the components, elements or units may be performed through the bus. Functional aspects of the above exemplary embodiments may be implemented in algorithms that execute on one or more processors. Furthermore, the components, elements or units represented by a block or processing steps may employ any number of related art techniques for electronics configuration, signal processing and/or control, data processing and the like.

At least part of an apparatus (e.g., modules or functions thereof) or a method (e.g., operations) according to various exemplary embodiments may be, for example, implemented by instructions stored in a computer-readable storage media in the form of a program module. The instruction, when executed by one or more processors (e.g., a processor), may cause the one or more processors to perform a function corresponding to the instruction. The computer-readable storage media, for example, may be the memory.

A computer-readable recording media may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk), and hardware devices (e.g., a read only memory (ROM), a random access memory (RAM), or a flash memory). Also, the program instructions may include not only a mechanical code such as things generated by a compiler but also a high-level language code executable on a computer using an interpreter. The above hardware unit may be configured to operate via one or more software modules for performing an operation, and vice versa.

A module or a program module according to various exemplary embodiments may include at least one of the above elements, or a part of the above elements may be omitted, or additional other elements may be further included. Operations performed by a module, a program module, or other elements according to various exemplary embodiments may be executed sequentially, in parallel, repeatedly, or in a heuristic method. Also, part of operations may be executed in different sequences, omitted, or other operations may be added.

When there are a plurality of serially connected light emitting modules for emitting back light to respective areas of a display, a back light device may adjust an on/off period of a power switch such that a ripple value of a constant current being supplied to a plurality of light emitting modules is uniformly maintained even if a voltage across the plurality of light emitting modules changes when the plurality of light emitting modules are turned on or off. Accordingly, the jitter may be prevented.

While the disclosure has been shown and described with reference to various exemplary embodiments thereof, it will be understood by those skilled in the art that various changes in form and details may be made therein without departing from the spirit and scope of the disclosure as defined by the appended claims and their equivalents.

What is claimed is:

1. A back light device comprising:

a first light emitting block comprising a first plurality of light emitting modules connected in series to each other;

a power supply module configured to apply a driving voltage to the first light emitting block;

a first power switch connected to the first light emitting block and configured to control the driving voltage on or off; and a control module configured to turn on or off the first power switch such that a constant current is supplied to the first light emitting block and to control an on/off of the first plurality of light emitting modules based on a dimming signal, wherein the control module is configured to, in response to a ripple value of the constant current being different from a certain ripple value, change at least one of a turn-on period and a turn-off period of the first power switch to calibrate the ripple value of the constant current to the certain ripple value.

2. The back light device of claim 1, wherein the control module is configured to:

change the turn-off period of the first power switch to calibrate the ripple value of the constant current.

3. The back light device of claim 2, wherein the control module is configured to:

decrease the turn-off period of the first power switch in response to the ripple value of the constant current being greater than the certain ripple value; and increase the turn-off period of the first power switch in response to the ripple value of the constant current being smaller than the certain ripple value.

4. The back light device of claim 1, wherein the control module is configured to:

change the turn-on period and the turn-off period of the first power switch to calibrate the ripple value of the constant current.

5. The back light device of claim 4, wherein the control module is configured to:

change the turn-on period and the turn-off period of the first power switch while a ratio of the turn-on period to the turn-off period is maintained.

6. The back light device of claim 4, wherein the control module is configured to:

decrease the turn-on period and the turn-off period in response to the ripple value of the constant current being greater than the certain ripple value; and increase the turn-on period and the turn-off period in response to the ripple value of the constant current being smaller than the certain ripple value.

7. The back light device of claim 1, further comprising:

a resistor connected between the first light emitting block and a ground, wherein the control module is configured to:

measure a current flowing to the resistor;

verify the ripple value of the constant current flowing to the first light emitting block by using the measured current; and calibrate the ripple value of the constant current in response to the ripple value of the constant current being different from the certain ripple value.

8. The back light device of claim 1, further comprising:

a plurality of channel switches respectively connected with the first plurality of light emitting modules, wherein the control module is configured to control an on/off of the plurality of channel switches.

9. The back light device of claim 8, wherein the control module is configured to:

turn off the first power switch in response to the first plurality of light emitting modules being off.

10. The back light device of claim 1, wherein the control module comprises a first control module and a second control module, wherein the first control module is configured to:

control the on/off of the first plurality of light emitting modules based on the dimming signal;

verify the constant current; and transmit a signal for controlling the first power switch to the second control module in response to the ripple value of the constant current being different from the certain ripple value, and wherein the second control module is configured to calibrate the ripple value of the constant current by changing the at least one of the turn-on period and the turn-off period of the first power switch in response to the signal for controlling the first power switch.

11. The back light device of claim 1, wherein the first light emitting block further comprises:

at least one light emitting module connected in parallel with at least a part of the first plurality of light emitting modules.

12. The back light device of claim 1, further comprising:

a second light emitting block comprising a second plurality of light emitting modules connected in series to each other and connected in parallel with the first light emitting block, wherein the power supply module is configured to supply the driving voltage to the second light emitting block and further comprises a second power switch, the second power switch connected to the second light emitting block and configured to control the driving voltage on or off.

13. The back light device of claim 12, wherein the control module is configured to:

turn on or off the second power switch such that the constant current is supplied to the second light emitting block, control an on/off of the second plurality of light emitting modules included in the second light emitting block based on the dimming signal, and calibrate the ripple value of the constant current to the certain ripple value by changing an on/off period of the second power switch in response to the ripple value of the constant current supplied to the second light emitting block being different from the certain ripple value.

14. A method for controlling a back light device, the method comprising:

turning on or off a first power switch to supply a constant current to a first light emitting block;

turning on or off a plurality of light emitting modules included in the first light emitting block based on a dimming signal;

verifying the constant current supplied to the first light emitting block; and in response to a ripple value of the constant current being different from a certain ripple value, changing at least one of a turn-on period and a turn-off period of the first power switch to calibrate the ripple value of the constant current.

15. The method of claim 14, wherein the changing comprises:

changing the turn-off period of the first power switch to calibrate the ripple value of the constant current.

16. The method of claim 14, wherein the changing comprises:

changing the turn-on period and the turn-off period of the first power switch to calibrate the ripple value of the constant current.

17. The method of claim 16, wherein the changing the turn-on period and the turn-off period comprises:

changing the turn-on period and the turn-off period while a ratio of the turn-on period to the turn-off period is maintained.

18. The method of claim 14, wherein the verifying the constant current comprises:

measuring a current flowing to a resistor connected between the first light emitting block and a ground.

19. A non-transitory computer-readable recording medium storing a program which, when executed by a computer, causes the computer to perform:

turning on or off a first power switch to supply a constant current to a first light emitting block;

turning on or off a plurality of light emitting modules included in the first light emitting block based on a dimming signal;

verifying the constant current supplied to the first light emitting block; and in response to a ripple value of the constant current being different from a certain ripple value, changing at least one of a turn-on period and a turn-off period of the first power switch to calibrate the ripple value of the constant current.

20. The non-transitory computer-readable recording medium of claim 19, wherein the changing comprises:

changing the turn-off period of the first power switch to calibrate the ripple value of the constant current.

* * * * *